US006113474A

United States Patent [19]

Shih et al.

[11] Patent Number: 6,113,474

[45] Date of Patent: Sep. 5, 2000

[54] CONSTANT FORCE TRUING AND DRESSING APPARATUS AND METHOD

[75] Inventors: Albert J. Shih; Tom M. Yonoshonis; M. B. Grant, all of Columbus, Ind.

[73] Assignee: Cummins Engine Company, Inc., Columbus, Ind.

[21] Appl. No.: 08/942,439

[22] Filed: Oct. 1, 1997

[51] Int. Cl.[7] ..... B24B 9/00

[52] U.S. Cl. ..... 451/72; 451/5; 451/14

[58] Field of Search ..... 451/5, 11, 14, 451/56; 125/11.03

[56] References Cited

U.S. PATENT DOCUMENTS

| | | | |
|---|---|---|---|
| 3,971,358 | 7/1976 | Sawluk . | |
| 4,085,554 | 4/1978 | Sugita . | |
| 4,151,684 | 5/1979 | Wada et al. | 451/72 |
| 4,228,782 | 10/1980 | Demers et al. . | |
| 4,419,979 | 12/1983 | Hughes . | |
| 4,551,950 | 11/1985 | Unno et al. | 451/5 |
| 4,640,057 | 2/1987 | Salje | 451/5 |
| 4,811,721 | 3/1989 | Altfather . | |
| 4,897,967 | 2/1990 | Maruyama et al. | 451/11 |
| 4,915,089 | 4/1990 | Ruark et al. | 451/11 |
| 4,920,945 | 5/1990 | Wedeniwski . | |
| 4,953,522 | 9/1990 | Vetter | 451/5 |
| 5,025,594 | 6/1991 | Lambert, Jr. et al. . | |
| 5,088,240 | 2/1992 | Ruble et al. | 451/5 |
| 5,146,909 | 9/1992 | Ruark et al. | 451/56 |
| 5,194,126 | 3/1993 | Packalin . | |
| 5,272,843 | 12/1993 | Maruyama et al. | 451/56 |
| 5,547,414 | 8/1996 | Ohmori | 451/56 |
| 5,643,051 | 7/1997 | Zhou et al. | 451/5 |
| 5,885,149 | 3/1999 | Gillet et al. | 451/546 |

*Primary Examiner*—David A. Scherbel
*Assistant Examiner*—Lee Wilson
*Attorney, Agent, or Firm*—Nixon Peabody LLP; Charles M. Leedom, Jr.

[57] ABSTRACT

Both an apparatus and method for truing and dressing a grinding wheel with a constant tangentially dressing force is provided. The apparatus includes a rotatable diamond dressing roll, an engagement assembly including a servo-motor for forcefully engaging the dressing roll against the peripheral work surface of the grinding wheel, a sensor for sensing the force of engagement between the dressing roll and the grinding wheel, and a microprocessor connected to both the sensor and the power supply for the servo-motor for modulating both the voltage and polarity of a DC current connected to the servo-motor so that the engagement assembly presses the diamond dressing roll against the grinding wheel with a constant force during the entire dressing operation. Both the apparatus and method are particularly adapted for truing and dressing of hard, high density silicon carbide grinding wheels and advantageously protract the life span of the diamond dressing roll while truing and dressing the grinding wheel to tighter tolerances.

17 Claims, 3 Drawing Sheets

CONSTANT FORCE TRUING AND DRESSING APPARATUS AND METHOD

BACKGROUND OF THE INVENTION

This invention generally relates to techniques for truing and dressing grinding wheels, and is particularly concerned with both a device and method that trues and dresses a grinding wheel with a constant force in order to protract the life span of the dressing roll, and to improve the accuracy of the truing operation.

Devices for truing and dressing grinding wheels are well known in the prior art. In the grinding arts a "truing" operation is performed on a grinding wheel in order to insure that the profile of its peripheral work surface is cut to a proper shape and is also concentric at all points with the axis of rotation of the wheel. By contrast, a "dressing" operation creates the desired abrasive condition on the surface of the grinding wheel. Truing and dressing operations are often performed on both newly manufactured and used grinding wheels to initiate and maintain a desired profile and proper surface conditions on the wheel. The truing operation properly shapes the wheel by grinding away a portion of the peripheral surface of the wheel in accordance with a pattern, while the dressing operation removes some of the bonding agent that surrounds the particles of abrasive material from the wheel surface, thereby exposing more of the sharp edges of these abrasive particles to better cut a workpiece.

In prior art truing and dressing operations, the grinding wheel is rotated while a truing and dressing tool is engaged against its outer periphery. In order to be effective, the truing and dressing tool must be formed from an abrasive material that is harder than the abrasive used in the grinding wheel. The grinding wheel, in turn, must be formed from abrasive materials that are harder than the material forming the workpiece. Because of the ever increasing demand for workpieces formed from ever harder work materials, there is an increasing use of truing and dressing tools that employ only the very hardest abrasive materials, i.e., diamond or CBN. Unfortunately, diamond and CBN truing and dressing tools are quite expensive. A single diamond roll used in such a tool costs approximately $6,000.00. Worst yet, the applicant has observed that the life span of such a diamond roll has been substantially shortened when the roll is used to true and dress the harder grinding wheels which are employed more and more to machine the much demanded harder workpieces. For example, while such a diamond roll could perform truing and dressing operations on conventional fused aluminum oxide grinding wheels for up to a year, its life time is attenuated to only one or two months when the same roll is used to true and dress harder silicon carbide and sol-gel aluminum oxide grinding wheels. The short life span of the diamond truing and dressing roll not only increases the cost of the shaping and machining operation on the workpieces, but also substantially increases downtime at the factory. Moreover, the use of harder grinding wheels has also increased the time necessary for satisfactorily completing a truing and dressing operation to acceptable tolerances, which again increases the downtime and expense associated with the grinding operation.

Clearly, there is a need for a device and method for truing and dressing grinding wheels employing hard abrasives which increases the life span of the diamond roll used in the truing and dressing tools. Ideally, such a device should reduce the time necessary for satisfactorily completing a truing and dressing operation so as to minimize downtime. Finally, it would be desirable if such a device and technique were capable of truing and dressing such hard grinding wheels with a high degree of precision to enable the wheels to shape and machine their respective workpieces to tight tolerances.

SUMMARY OF THE INVENTION

Generally speaking, the invention is both an apparatus and method for truing and dressing a grinding wheel employing a hard abrasive material, such as silicon carbide, CBN, or sol-gel aluminum oxide, with a substantially constant force in order to overcome all of the aforementioned disadvantages associated with the prior art. The invention stems from the observation by the inventor of the undesirable affects caused by the use of variable and high maximum engagement forces between the diamond dressing roll and the peripheral work surface of such grinding wheels. As is illustrated in FIG. 1A, prior art dressing and truing operations were implemented by feeding the dressing roll against the grinding wheel at a constant rate of speed. Such a technique resulted in a constantly increasing tangential engagement force between the diamond dressing roll and the peripheral work surface of the grinding wheel that peaked at a value of approximately 25 newtons. Thereafter, the engagement force steadily decreased down to zero. The applicant observed that the application of such a variable and high maximum tangential engagement force not only substantially shortened the life span of the diamond dressing roll, but also created unwanted surface irregularities in the grinding wheel which necessitated a larger truing and dressing operation to correct, and which could result in cuts in the workpiece of undesirably loose tolerances. By contrast, in the apparatus and method of the invention, the engagement force between the diamond dressing roll and the outer periphery of the grinding wheel is maintained at a constant level of approximately 11 newtons throughout the 25 second duration of the dressing operation, as is indicated by the solid line in FIG. 1A. Such a constant force truing and dressing operation not only substantially lengthens the life span of the diamond dressing roll, but initially trues and dresses the grinding wheel to tight tolerances, thereby obviating the need for a longer truing and dressing operation, while allowing the grinding wheel to shape and machine workpieces to tight tolerances.

In its simplest form, the apparatus of the invention comprises a truing and dressing tool including a diamond dressing roll, an engagement assembly for forcefully engaging the diamond dressing roll against the peripheral surface of the grinding wheel, and a sensor for sensing a tangential force of engagement between the diamond dressing roll and the grinding wheel and for generating an electrical signal corresponding to the tangential engagement force. The apparatus further comprises a microprocessor having an input connected to the engagement force sensor, and an output connected to the engagement assembly for maintaining a selected force of tangential engagement during the entire truing and dressing operation.

The engagement assembly may include a movable carriage for rotatably supporting the diamond dressing roll, and a linkage such as a lead screw for advancing and retracting the carriage toward and away from the grinding wheel, and a servo-motor for driving the lead screw. The output of the microprocessor may be electrically connected to the servo-motor for regulating the amount and polarity of the electrical current powering the same.

The engagement sensor may be of either the piezio electric or strain-gauge type and may be located in the carriage for sensing the tangential force applied between the diamond dressing roll and the grinding wheel. Alternatively, the sensor may be a Hall effect type sensor connected to the power cables leading to the electric motors which turn either the grinding wheel or the diamond dressing roll of the truing and dressing tool. As either of these electric motors draws more power in direct proportion to the dressing force generated between the surface of the diamond dressing roll and the peripheral work surface of the grinding wheel, the electrical signal generated by such a Hall effect sensor advantageously generates an electrical signal which the microprocessor can use in controlling the movement of the carriage of the engaging assembly to develop and maintain a tangential engagement force at the desired level of approximately 11 newtons for the desired time period of approximately 25 seconds.

The invention further encompasses a method for truing and dressing a grinding wheel with a tool that comprises the steps of generating a relative movement between a peripheral work surface of the grinding wheel and the tool, engaging the tool against the peripheral work surface of the grinding wheel until a selected engagement force is achieved, and maintaining the selected engagement force at a substantially constant level until the grinding wheel is trued and dressed. As previously indicated with respect to the apparatus of the invention, the selected engagement force is a tangential force of between about 8 and 13 newtons, and most preferably about 11 newtons. The distance traversed by the dressing roll of the truing and dressing tool into the peripheral surface of the grinding wheel is between about 10 to 20 $\mu$m. The invention is generally applicable to a variety of grinding wheels of different hardnesses and truing and dressing tools of different configurations, the specific tangential engagement forces and engagement periods are most applicable to a grinding wheel having a peripheral work surface formed from 36% by volume of particles of silicon carbide and 33% by volume of a porcelain bonding agent wherein the work surface of the wheel has a porosity of no more than about 35%, and more preferably of 31% or lower.

DETAILED DESCRIPTION OF THE PREFERRED EMBODIMENT

Figure 1A:
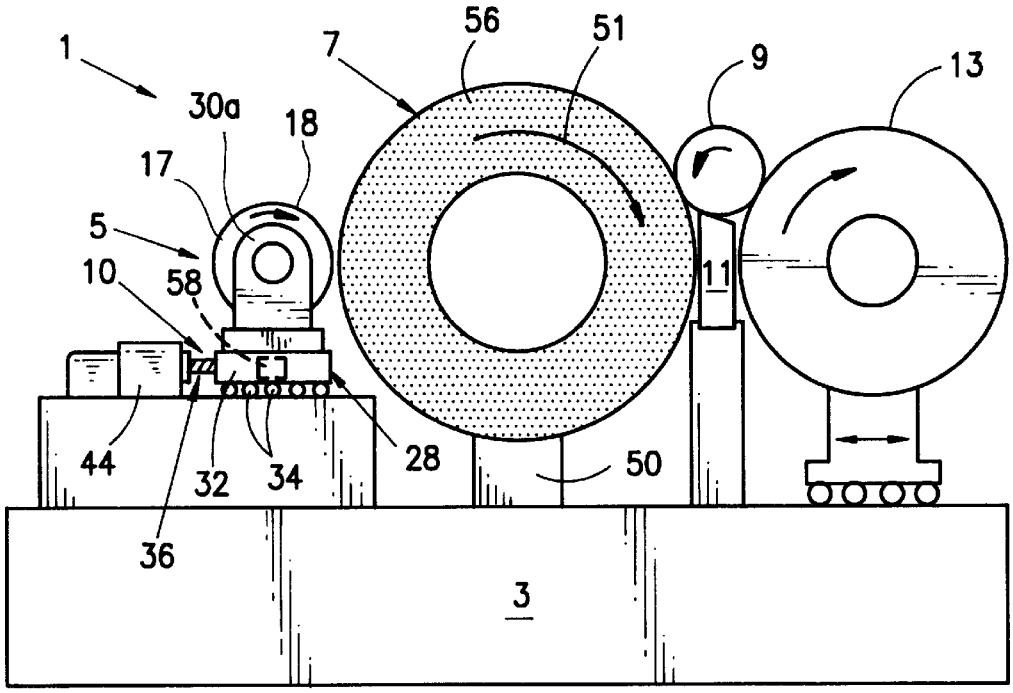
FIG. 1A is a side view of one embodiment of the constant force truing and dressing device of the invention.
Figure 1B:
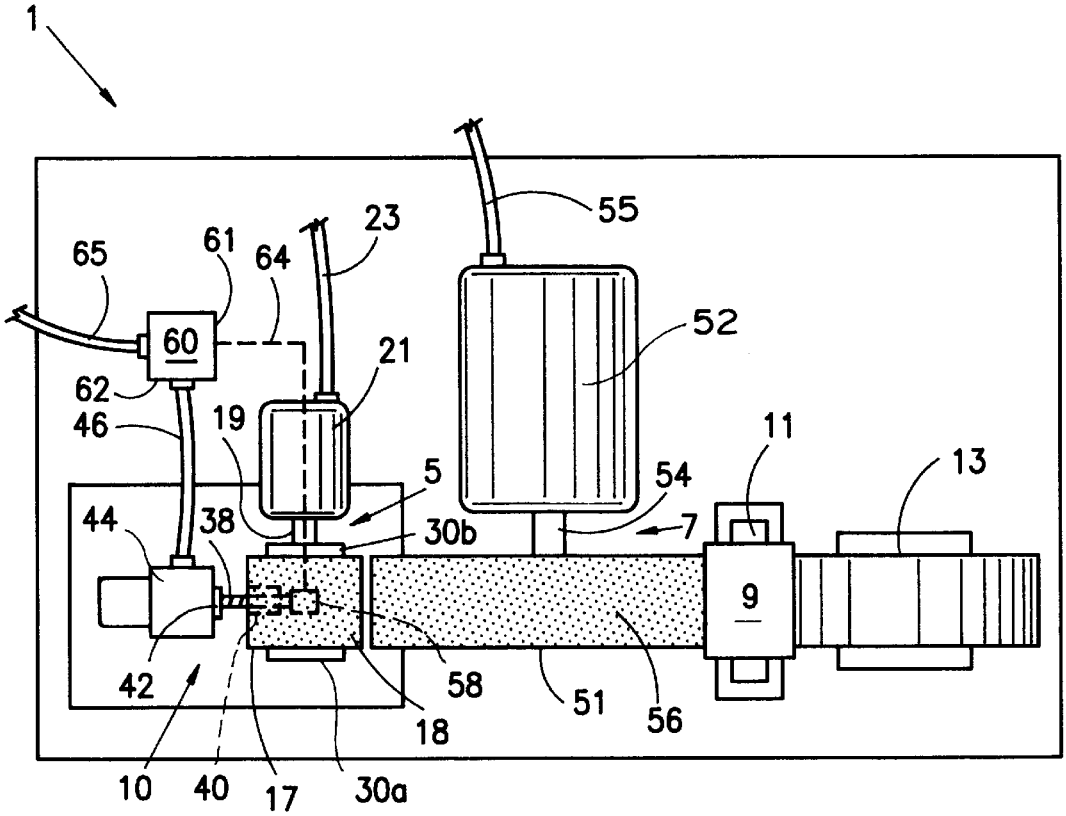
FIG. 1B is a plan view of the device illustrated in FIG. 2A.

With reference now to FIGS. 1A and 1B wherein like numbers designate like components throughout all the several figures, the constant force truing and dressing device 1 of the invention generally comprises a base 3 that supports a truing and dressing tool 5 on one side of a grinding wheel assembly 7. A centerless workpiece 9 is present in this example on the opposite side of the grinding wheel assembly 7. The truing and dressing tool 5 is connect to an engagement assembly 10 that functions to extend and retract the diamond dressing roll of the tool 5 toward and away from the grinding wheel of the assembly 7. The centerless workpiece 9 is simultaneously supported by both a column-like blade 11 and the surface of a regulating wheel 13. The blade 11 and wheel 13 controllably rotate the workpiece 9 during a grinding operation in a manner that is well known in the prior art.

The truing and dressing tool 5 includes the previously-mentioned rotatable diamond roll 17. Roll 17 includes a peripheral grinding surface 18 containing small grains of abrasive diamond for both shaping and dressing the peripheral work surface of the grinding wheel. Roll 17 is connected to the output shaft 19 of an electric motor 21 (illustrated in FIG. 1B). Motor 21 is connected to an electric power cable 23 as shown.

The engagement assembly 10 includes a movable carriage 28 for rotatably supporting the diamond roll 17 and for carrying the electric motor 21. To this end, the carriage 28 includes a pair of opposing support lugs 30*a,b* for supporting the output shaft 19 of the motor 21. The support lugs 30*a,b* are connected at their bottom portions to a carriage base 32 extends under the motor 21 and which is linearly movable both toward and away from the grinding wheel of the assembly 7 via balls or rollers 34. The engagement assembly 10 further includes the combination of a linkage 36 and servo-motor 44 for extending and retracting roll 17 of the truing and dressing tool 5 into and out of engagement with the periphery of the grinding wheel. The linkage 36 is formed from the combination of a lead screw 38 which is engaged to a ball screw receiver 40 located in carriage base 32 at one end, and connected to the output shaft 42 of the servo-motor 44 at its other end. The servo-motor 44 is powered via input cable 46 as shown in FIG. 1B.

The grinding wheel assembly 7 includes a support base 50 for supporting the combination of a grinding wheel 51 and electric drive motor 52. An output shaft 54 on one end of the electric motor 52 connects the motor with the wheel 51. A power cable 55 connected at the opposite side of the motor 52 supplies it with electric power. The grinding wheel 51 includes a peripheral work surface 56 for shaping and machining the workpiece 9. While peripheral work surface 56 in the device illustrated throughout FIGS. 1A–3 has a simple cylindrical profile, it should be noted that the work surface 56 may have any number of differently shaped profiles depending upon the specific shaping operation it is to perform on the workpiece 9.

In the embodiment 1 of the device illustrated in FIG. 1A and 1B, a force sensor 58 is mounted between the ball screw receiver 40 and an opposing wall of the carriage base 32. In this embodiment 1, the force sensor 58 may be of either the piezio electric or strain-gauge type which generates an electric signal which is proportional in amplitude to the amount of compressive or tensile mechanical force it experiences. The device 1 further includes a microprocessor 60 having both an input 61 and output 62. The input 61 receives the electrical signal generated by the sensor 58 via cable 64, and converts it into an engagement force, while the output 62 of the microprocessor 60 regulates the amount and polarity of the electrical power supplied to the power input cable 46 of the servo-motor 44. The microprocessor 60 is further connected to power cable 65, and includes a power regulation circuit for converting the power received into a regulated DC current whose voltage and polarity appropriately actuates the servo-motor 44 to turn the lead screw 38 in such a manner as to either advance or retract the diamond roll 17 toward or away from the outer periphery 56 of the grinding wheel 51. The microprocessor 60 of the truing and dressing device in accordance with the present invention may also include a timing circuit (not shown) such that the microprocessor maintains the selected force of engagement between the truing and dressing tool and the grinding wheel for a preselected time period. The details of such selectable timing circuits are well known in the electronic arts and need not be discussed further here.

Figure 2:
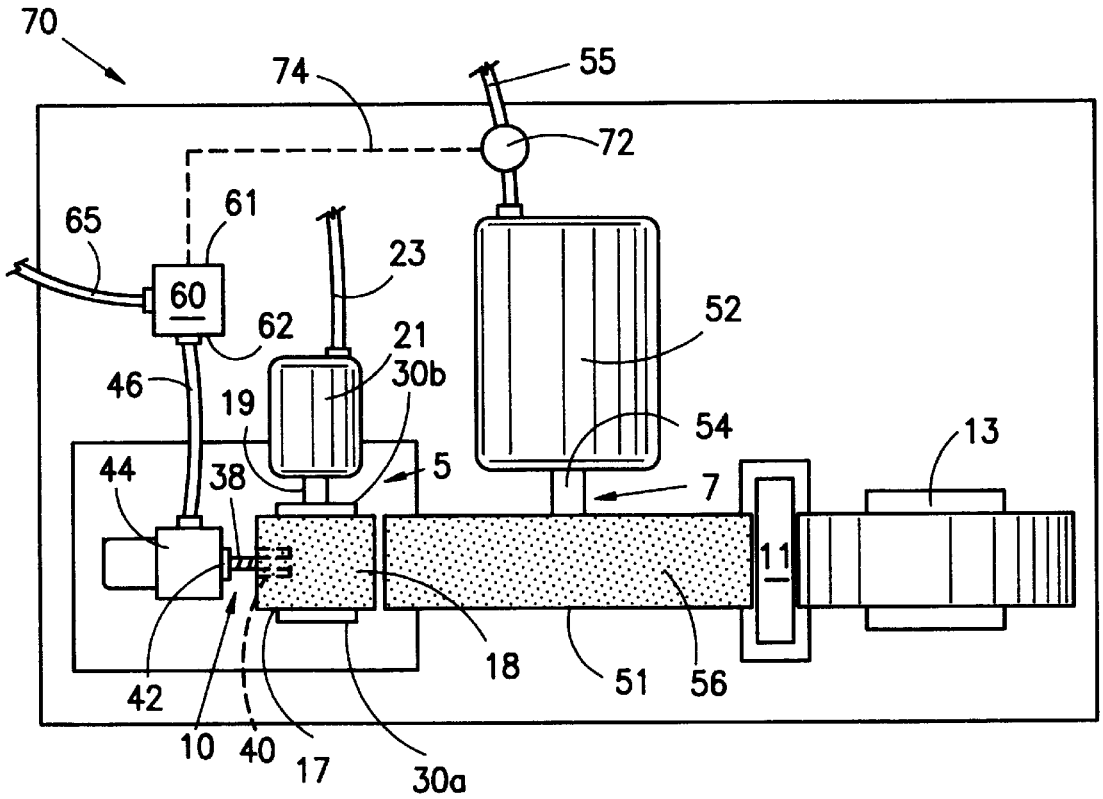
FIG. 2 is a plan view of a second embodiment of the device of the invention.

FIG. 2 illustrates an alternate embodiment 70 of the device of the invention. In this embodiment, the force sensor 58 of the first embodiment is replaced with a Hall effect sensor 72 connected across the power cable 55 of the grinding wheel electric motor 52. When the diamond roll 17 of the truing and dressing tool 5 is advanced into the peripheral work surface 56 of the grinding wheel 51, a mechanical resistance is applied to the grinding wheel 51 which is proportional to the tangential force experienced by the peripheral grinding surface 18 of the diamond roll 17. This mechanical resistance increases the power demand of the electric motor 52 which is in turn detected by the Hall effect sensor 72. The Hall effect sensor 72 generates an electric signal proportional to this increase in power demand which in turn is proportional to the aforementioned tangential force, and transmits it to the input 61 of the microprocessor 60 via control cable 74. The microprocessor 60 translates this signal into a tangential force, and then proceeds to regulate the power received through cable 65 into a controlled voltage and controlled polarity DC current that flows through the cable 46 into the servo-motor 44 to appropriately advance or retract the diamond dressing roll 17 to develop and maintain a preselected engagement force.

Figure 3:
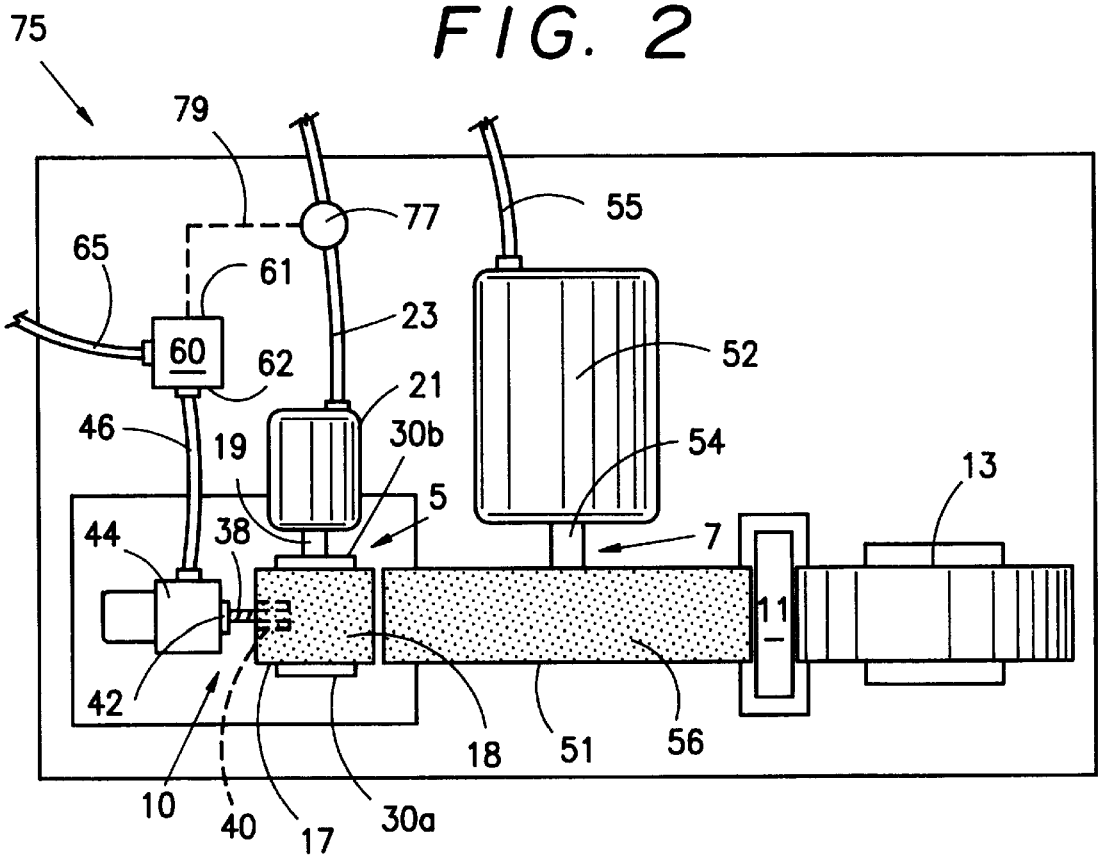
FIG. 3 is a plan view of a third embodiment of the device of the invention.

FIG. 3 illustrates still another embodiment 75 of the device of the invention. In this embodiment 75, the Hall effect sensor 72 of the embodiment 70 has been removed, and reinstalled across the power cable 23 leading into the servo-motor 21. When the diamond dressing roll 71 is engaged against the peripheral work surface 56 of the grinding wheel 51, a mechanical resistance is applied to the diamond dressing roll 17. This mechanical resistance in turn causes the electric motor 21 driving the roll 17 to demand more electric power through the cable 23 which is sensed via the Hall effect sensor 77. The Hall effect sensor 77 generates an electrical signal proportional to the amount of increased power demand, and transmits this signal into the input 61 of the microprocessor 60 via control cable 79. The microprocessor again translates this signal into a measured tangential engagement force, and converts AC power received via cable 65 into a modulated, controlled polarity DC current that flows into the servo-motor 44 via cable 46 to develop and maintain a desired engagement force.

Figure 4A:
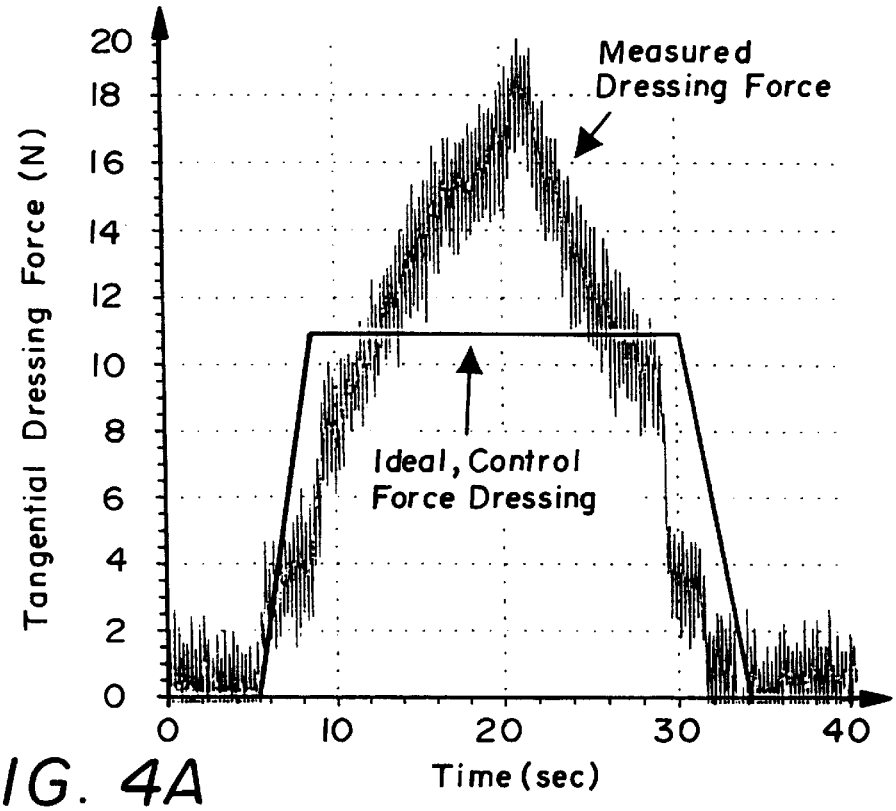
FIG. 4A is a graph illustrating the tangential dressing force N experienced by the diamond dressing roll over time in a prior art truing and dressing operation (jagged line) versus an operation made in conformance with the invention (smooth line), and FIG. 4B also illustrates the tangential dressing force N experienced by a diamond dressing roll over time in a conventual, periodic truing and dressing operation.
Figure 4B:
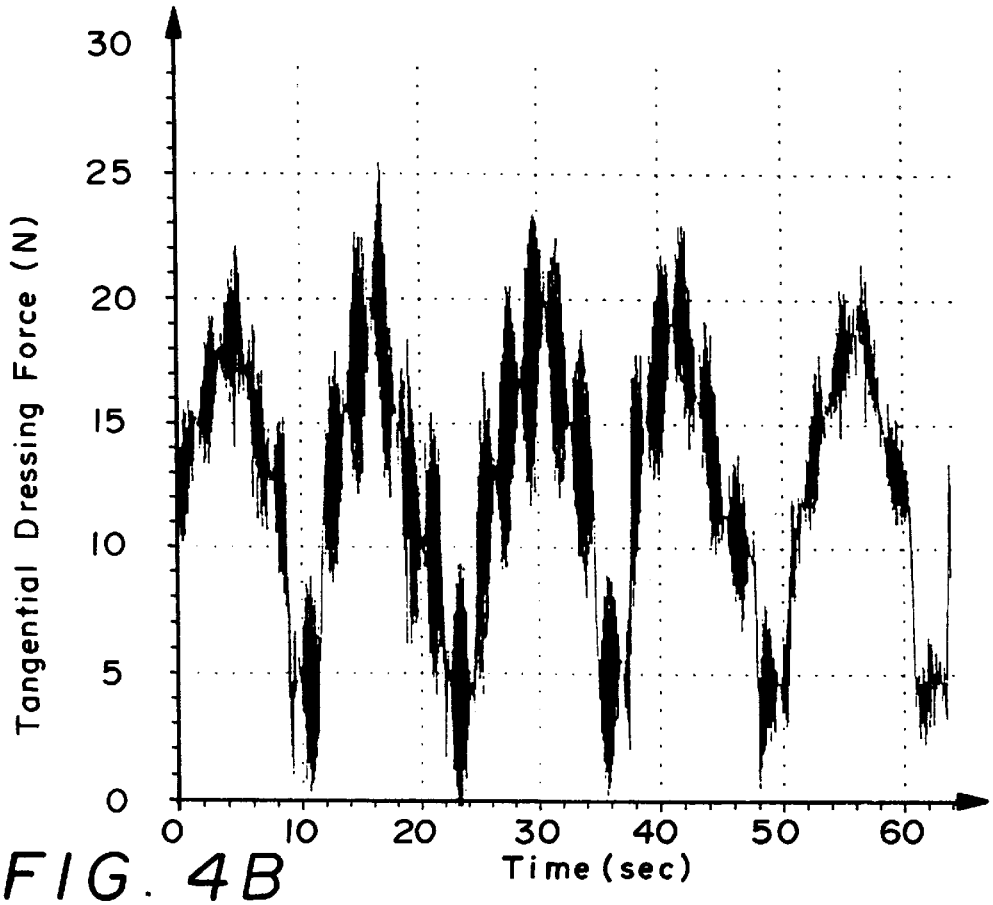

FIGS. 4A and 4B illustrate the difference between the tangential dressing force N experienced by the peripheral grinding surface 18 of the diamond dressing roll 17 over time for a conventional dressing operation (indicated by the jagged line) versus a truing and dressing operation conducted in accordance with the invention (indicated by the solid line in FIG. 4A). In a conventional, one-cycle truing and dressing operation, the diamond dressing roll 17 is rapidly extended at a constant feed rate into the peripheral work surface 57 of the grinding wheel 51 while both electric motors 21 and 52 are in operation in order to both true the surface 56 into a desired shape, and to dress this surface to properly expose the abrasive particles used in the wheel 51. Typically, the diamond dressing roll 17 must abrade off between 10 and 20 $\mu$m of materials off the peripheral work surface 56 before the wheel 51 is properly trued and dressed. When the operator of the truing and dressing tool performs the operation in the conventional manner, the tangential dressing force ranges to between zero to a peak of approximately 20–25 newtons, and then steadily falls back to zero newtons over a time period of approximately 24 seconds. The applicant has observed that the use of a constantly changing tangential dressing force characterized by a high peak of 20–25 newtons not only tends to greatly accelerate the wear of the diamond dressing wheel 17, but also creates irregularities around the periphery of the work surface 56 and the grinding wheel 51 which can lead to an inaccurate cutting action on the workpiece 9. This problem is exacerbated in the prior art in the case where a diamond dressing roll 17 is used to cut a more complicated profile across the edge of the peripheral work surface 56 of the wheel 51. The tangential dressing forces experienced by the peripheral work surface 56 are illustrated in FIG. 4B, and are characterized by highly variable tangential dressing forces which range from zero to 25 newtons over multiple time periods of 10 or 11 seconds. By contrast, each of the embodiments 1, 70, and 75 operates in such a manner as to engage the grinding surface 18 of the diamond dressing roll 17 against the peripheral work surface 56 of the wheel 51 with a constant force of approximately 11 newtons during the entire time period of the dressing operation, even when the dressing roll 17 is used to cut a relatively complex profile into the surface 56. The force-over-time curve that results from the invention (which is illustrated by the straight black line in FIG. 4A) not only doubles or triples the life of the diamond dressing roll 17, but also results in a quicker and more accurate truing of the peripheral work surface 56 along with a better dressing thereof so that the wheel 51 can cut a workpiece 9 to tighter tolerances.

While this invention has been described with respect to several preferred embodiments, additional variations and modifications of the invention will become apparent to persons of skill in the art. All such modifications, variations, and additions are within the scope of this invention, which is limited only by the claims appended hereto.

What is claimed:

1. Apparatus for truing and dressing a grinding wheel with a substantially constant force, comprising:

a truing and dressing tool;

an engagement assembly for forcefully engaging said truing and dressing tool against said grinding wheel at a selected substantially constant force;

means for sensing a force of engagement between said truing and dressing tool and said grinding wheel and for generating an electrical signal corresponding to said sensed force, and a microprocessor having an input connected to said signal generated by said sensing means and an output connected to said engagement assembly for maintaining said selected, substantially constant force of engagement between said truing and dressing tool and grinding wheel during a truing and dressing operation.

2. The truing and dressing apparatus of claim 1, wherein said engagement assembly includes a linkage for advancing and retracting said truing and dressing tool into and out of engagement with said grinding wheel, and a servo-motor for driving said linkage, and wherein said microprocessor output is connected to said servo-motor.

3. The truing and dressing apparatus of claim 2, wherein said engagement assembly further includes a movable carriage for supporting said truing and dressing tool, and said linkage includes a lead screw connected at one end to the output of said servo-motor, and at an opposite end to a screw receiver connected to said carriage.

4. The truing and dressing apparatus of claim 3, wherein said sensing means is located in said carriage and senses both normal and tangential forces applied between said truing and dressing tool and said grinding wheel.

5. The truing and dressing apparatus of claim 1, further comprising an electric motor connected to an electrical power source via a cable for driving said grinding wheel, and wherein said sensing means includes an electric power sensor connected to said power cable for generating an electric signal indicative of the amount of tangential force between said grinding wheel and said truing and dressing tool.

6. The truing and dressing apparatus of claim 1, wherein said truing and dressing tool includes a rotatable abrasive roll and an electric motor connected to an electrical power source via a cable for driving said abrasive roll.

7. The truing and dressing apparatus of claim 6, wherein said sensing means is an electric power sensor connected to said power cable of said electric motor for generating an electric signal indicative of the amount of tangential force between said abrasive roll and said grinding wheel.

8. The truing and dressing apparatus of claim 6, wherein said rotatable abrasive roll has a peripheral work surface that includes particles of diamond.

9. The truing and dressing apparatus of claim 1, wherein said grinding wheel has a peripheral work surface that includes particles of silicon carbide bound in a vitreous matrix having a porosity of between about 30% and 35%.

10. The truing and dressing apparatus of claim 1, wherein said microprocessor includes a timing circuit such that said microprocessor maintains said selected force of engagement between said truing and dressing tool and grinding wheel for a preselected time period.

11. Apparatus for truing and dressing a grinding wheel with a substantially constant force, comprising:

a truing and dressing tool including a rotatable abrasive roll having a peripheral work surface;

an engagement assembly operatively connected to said roll and including a servo-motor for forcefully engaging said roll against said grinding wheel at a selected, substantially constant tangential force;

means for sensing a tangential force of engagement between said peripheral work surface of said abrasive roll and a peripheral work surface of said grinding wheel and for generating an electrical signal corresponding to said sensed tangential force, and a microprocessor having an input connected to said signal generated by said sensing means and an output connected to said servo-motor of said engagement assembly for maintaining said selected substantially constant tangential force of engagement between said abrasive roll and grinding wheel during a truing and dressing operation.

12. The truing and dressing apparatus of claim 11, wherein said engagement assembly includes a movable carriage for rotatably supporting said abrasive roll and a lead screw connected between the output of said servo-motor and said carriage for advancing and retracting said carriage with respect to said grinding wheel.

13. The truing and dressing apparatus of claim 12, wherein said sensing means is located in said carriage and senses both normal and tangential forces applied between said abrasive roll and said grinding wheel.

14. The truing and dressing apparatus of claim 12, further comprising an electric motor connected to an electrical power source via a cable for driving said grinding wheel, and wherein said sensing means includes an electric power sensor connected to said power cable for generating an electric signal indicative of the amount of tangential force between said grinding wheel and said timing and dressing tool.

15. The truing and dressing apparatus of claim 11, wherein said truing and dressing tool includes an electric motor for driving said abrasive roll that is connected to an electrical power source via a cable, and said sensing means is an electric power sensor connected to said power cable of said electric motor.

16. The truing and dressing apparatus of claim 11, wherein said rotatable abrasive roll has a peripheral work surface that includes particles of diamond.

17. The truing and dressing apparatus of claim 11, wherein said grinding wheel has a peripheral work surface that includes particles of silicon carbide bound in a vitreous matrix having a porosity of between about 30% and 35%.

* * * * *